United States Patent [19]

Suzuki

[11] Patent Number: 4,754,851

[45] Date of Patent: Jul. 5, 1988

[54] CONTROL APPARATUS FOR ELEVATOR

[75] Inventor: Shigehiko Suzuki, Inazawa, Japan

[73] Assignee: Mitsubishi Denki Kabushiki Kaisha, Japan

[21] Appl. No.: 851,446

[22] Filed: Apr. 14, 1986

[30] Foreign Application Priority Data

Apr. 15, 1985 [JP] Japan ..... 60-79520
Apr. 15, 1985 [JP] Japan ..... 60-79521

[51] Int. Cl.[4] ..... B66B 5/02
[52] U.S. Cl. ..... 187/129; 187/134
[58] Field of Search ..... 187/29, 124, 129, 130, 187/134, 136; 340/21

[56] References Cited

U.S. PATENT DOCUMENTS 4,124,103 11/1978 Otto et al. ..... 187/29 R
4,317,506 3/1982 Quan et al. ..... 187/29 R
4,354,171 10/1982 Yoshida ..... 187/29 R X
4,367,811 1/1983 Yoneda et al. ..... 187/129
4,368,518 1/1983 Terazono et al. ..... 187/29 R X

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

A control apparatus for an elevator comprises a position detector responsive to cage movement, a non-volatile semiconductor memory for storing representation of cage position, and a microcomputer operated under program control for controlling the position detector to produce signals representing instantaneous cage positions and for continuously erasing and rewriting the contents of the non-volatile semiconductor memory based on the position detector signals. Thus, the stored contents can be reliably held even at the time of power failure, so that an expensive backup power source can be dispensed with.

7 Claims, 4 Drawing Sheets

CONTROL APPARATUS FOR ELEVATOR

BACKGROUND OF THE INVENTION

This invention relates to a control apparatus for an elevator which detects the current cage position of the elevator by means of a microcomputer. More particularly, it relates to a control apparatus for storing the current position of a cage without using a backup power source as well as a storing and holding circuit.

In control apparatuses for elevators, it is important for controlling the running of a cage to detect the current position of the cage and to store and hold the detected position. In a conventional elevator apparatus, therefore, an object which moves reducing the movement of the cage in a certain proportion is provided, and the signal of a contact which is actuated by the object is obtained as a cage position signal.

With the above construction, however, the durability is low because mechanical movable parts are included, and the device becomes large in size when the storeys of a building are high. In recent years, accordingly, a measure is taken wherein as described in the official gazette of Japanese Patent Application Laid-Open No. 56-65781 by way of example, a cage position is detected with a microcomputer, the detected cage position data is stored and held in a RAM (Random Access Memory), and the cage position data of the RAM is rewritten and held each time the cage position changes.

In addition, a measure which obtains the current position information of a cage and the position information of a service floor with a microcomputer is described in the official gazette of Japanese Patent Application Laid-Open No. 58-52169 by way of example.

Here, since the positions of service floor differ depending upon individual buildings, the position information items of service floors need to be stored for each building in advance. To this end, in the position detection apparatus disclosed in the official gazette of Japanese Patent Application Laid-Open No. 58-52169, a positional data measurement running is first carried out to store the absolute position information items of the respective service floors in a RAM. In an ordinary running mode, pulses generated in accordance with the ascent or descent of the cage are counted, and the addition or substraction between the count value and the absolute position information stored in the RAM is executed, thereby to find the current position of the cage, and the service floor and the current cage position are compared, thereby to detect a position such as slowdown initiation position.

With the control apparatus for an elevator having the above construction, however, the cage position data is stored in the RAM being a volatile memory and therefore disappears at the time of power failure, and the positional correlations between calls and the cage after the recovery of power supply become unclear, so that accurate response operations to the calls cannot be performed. This has led to the problem that an expensive backup power source, or a storing and holding circuit as disclosed in the official gazette of Japanese Patent Application Laid-Open No. 57-23565 is required in the case of employing the RAM for the storage of the cage position data.

On the other hand, there has also been proposed a method in which the positional information of service floors is stored in a ROM (Read Only Memory).

The positional information stored in the ROM can be held even when the stoppage of power supply has occured. However, the positional data items of service floors must be stored in the ROM by the use of a special tool. Moreover, these positional data items of the service floors cannot be exactly foreknown. This has been attended with such a problem that the special job of writing the positional information into the ROM is necessitated in the installation site of an elevator.

SUMMARY OF THE INVENTION

This invention has been made in order to solve the problems as stated above, and has for its object to provide a control apparatus for an elevator which can reliably hold the positional data of service floors at the time of power failure without requiring an expensive backup power source.

According to the present invention, a control apparatus for an elevator having a movable cage may comprise a position detector responsive to cage movement and a non-volatile semiconductor memory for storing representations of cage position. The control apparatus further comprises a microcomputer operated under program control for controlling the position detector to produce signals representing instantaneous cage positions and for continuously erasing and rewriting the contents of the non-volatile semiconductor memory based on position detector signals. The control apparatus thus provides a continuously updated representation of instantaneous cage position in a non-volatile memory which retains this information even in the event of a power failure.

According to the present invention, an elevator control apparatus may also comprise a pulse generator which produces output pulses corresponding to the movement of an elevator cage and a microcomputer for processing the count value of the output pulses to obtain a cage position and absolute positional data of the service floors. The elevator control apparatus further comprises a semiconductor memory which is non-volatile and which can have its content rewritten. The semiconductor memory is connected to the microcomputer and includes memory elements for storing absolute positional data of the service floors. Again, with the non-volatile memory of the elevator control apparatus, data is securely maintained in the event of a power failure so no back-up power source is required.

DESCRIPTION OF THE PREFERRED EMBODIMENTS

Figure 1:
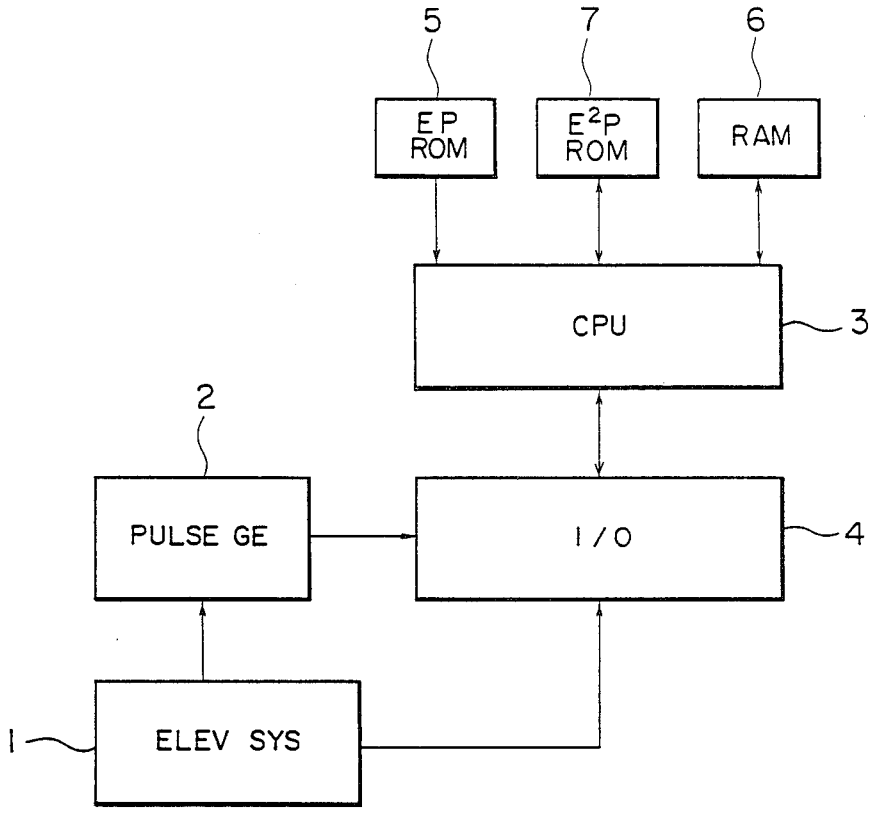
FIG. 1 is a block diagram showing a control apparatus for an elevator according to an embodiment of this invention.

Now, an embodiment of this invention will be described with reference to the drawings. Referring to FIG. 1, numeral 1 designates an elevator system. A pulse generator 2 produces pulses in accordance with the ascent and descent of a cage. A central processing unit (hereinbelow, termed 'CPU') 3 constitutes a microcomputer. An input/output interface 4 receives signals from the elevator system 1 and the pulse generator 2 and supplies them to the CPU 3, and it supplies the control output signal of the CPU 3 to the elevator system 1. An electrically programmable read-only memory (hereinbelow, termed 'EPROM') 5 stores programs to be executed in the CPU 3 and fixed data etc. previously determined, a random access memory (hereinbelow, termed 'RAM') 6 stores multifarious variable data, and an electrically erasable and programmable read-only memory (hereinbelow, termed 'E²PROM') 7 stores the positional data of service floors.

With the elevator apparatus thus constructed, when the installation job thereof has been completed, a floor position measurement running for storing the positional data of the respective service floors is carried out. More specifically, when a floor position measurement running mode has been established by setting a running mode setting switch or the like not shown, the cage shifts to the lowermost floor, and predetermined positional data corresponding to the bottom floor is set in the E²PROM 7. When a storing operation for the positional data of the bottom floor has ended, the cage is moved from the bottom floor toward the top floor. Herein, as the cage moves in the up direction, the pulse generator 2 produces pulses the number of which is proportional to the traveling distance of the cage. These pulses are supplied to the CPU 3 through the input/output interface 4, whereby the number of the pulses generated till the arrival of the cage at the next floor from the bottom floor is counted. The count number of the pulses is processed in the CPU 3, whereby an absolute position for the floor next the bottom floor is found, and the value is stored in the E²PROM 7. Thenceforth, absolute positions for all the service floors from the bottom floor to the top floor are similarly measured and stored in the E²PROM 7 successively.

Thereafter, the elevator is set to an ordinary running mode by the use of the running mode setting switch or the like, and current cage position data is compared with the absolute position data of the respective service floors having been measured and stored in the foregoing measurement mode. Thus, it becomes possible to detect the floor on which the cage is currently positioned, slowdown initiation positions, etc., so that the ordinary elevator running can be performed.

Figure 2:
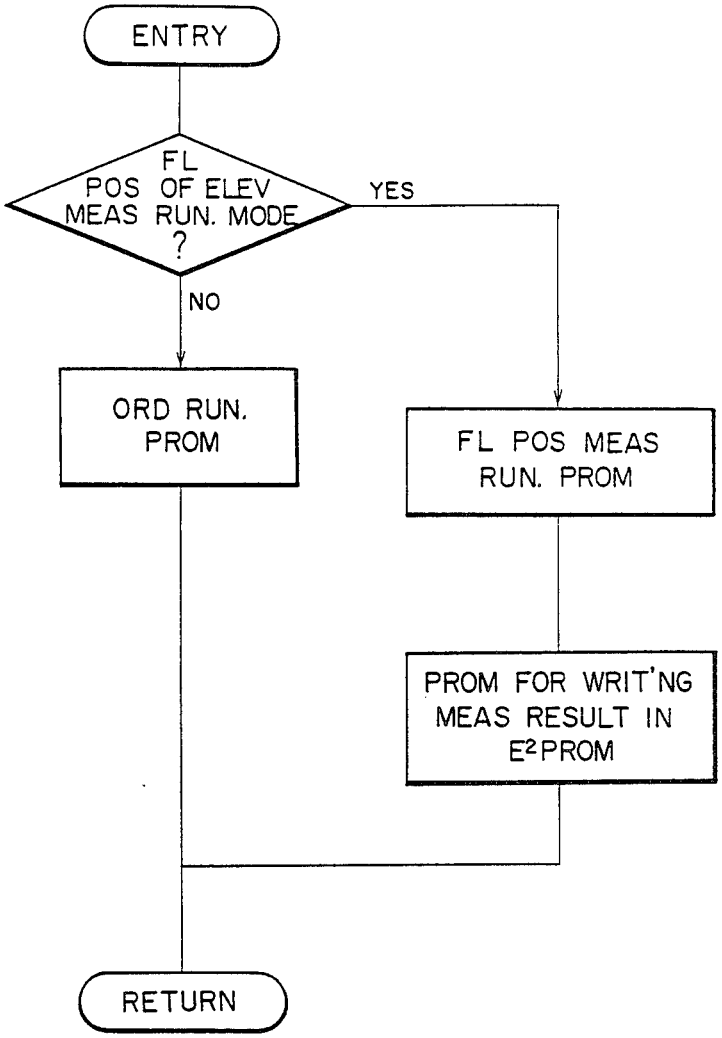
FIG. 2 is a flow chart showing steps for storing the positional data of service floors in an $E^2$PROM.

Here, the writing of data into the E²PROM 7 requires a much longer time than the writing of data into the RAM 6. As illustrated by a flow chart in FIG. 2, accordingly, the processing programs of the CPU are changed-over according to the setting of the running mode. In the floor position measurement running mode, only the programs necessary for the floor position measurement running and for the writing of the measured results into the E²PROM 7 are processed. That is, by way of example, among programs for the ordinary running, only those except programs for performing the detection of calls, responses to them, the display of a cage position, and the operations of various additional specifications are executed. In this way, the period of time of the writing into the E²PROM can be secured without employing a CPU of particularly high processing capability.

As described above, according to this invention, an E²PROM is employed as a memory for storing the positional data of service floors, and hence, the stored contents are reliably held even in case of power failure. The invention therefore has the effect that an expensive backup power source having hitherto been required is dispensed with.

Figure 3:
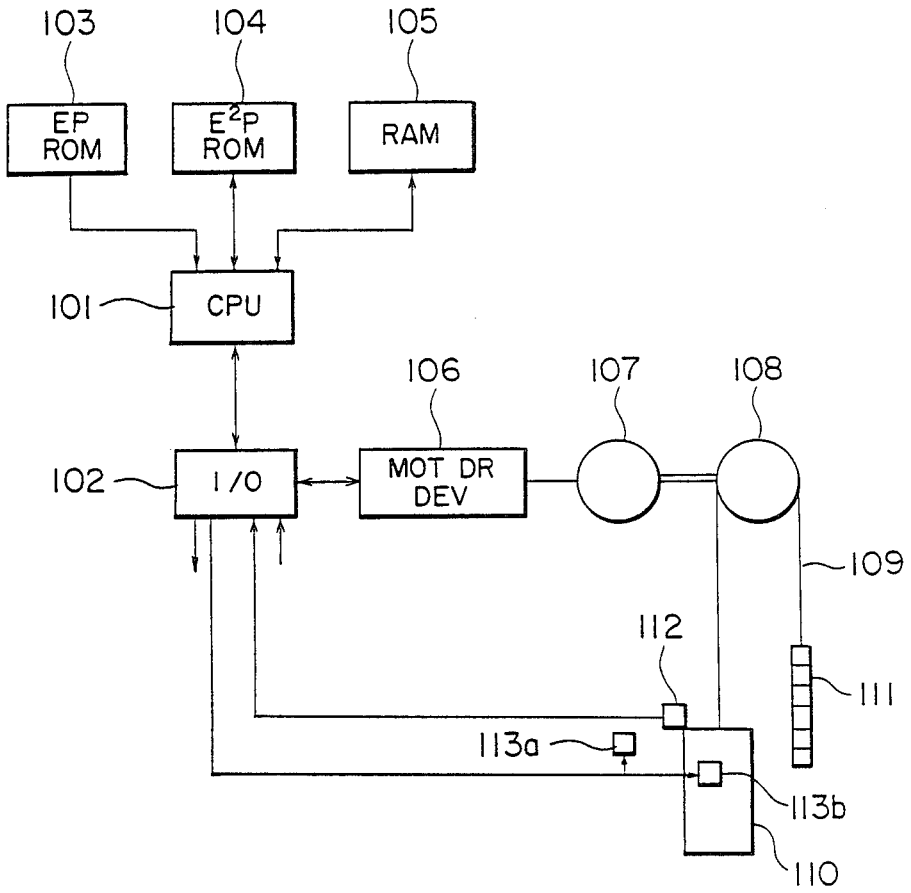
FIG. 3 is a block diagram of essential portions showing another embodiment of this invention.

Next, another embodiment of this invention will be described with reference to the drawings. Referring to FIG. 3, an elevator apparatus embodying this invention comprises a central processing unit (hereinbelow, termed 'CPU') which constitutes a microcomputer, an input/output interface 102 which supplies external input signals to the CPU 101 and which delivers out signals from the CPU 101, an electrically programmable read-only memory (hereinbelow, termed 'EPROM') 103 which stores programs to be executed in the CPU 101 and fixed data previously determined, an electrically erasable and programmable read-only memory (hereinbelow, termed 'E²PROM') 104 which stores the current position data of a cage (at numeral 110 mentioned below), a random access memory (hereinbelow, termed 'RAM') 105 which stores multifarious variable data, a motor drive device 106 which drives a main motor 107 in accordance with the output of the input/output interface 102, a sheave 108 which is coupled to the main motor 107, a main rope 109 which is wound round the sheave 108, the cage 110 and a counterweight 111 which are connected to both the ends of the main rope 109, and a position detector 112 whose output signal is supplied to the input/output interface 102. Cage position display units **113*a* and 113*b* are installed in a hall and the cage respectively, and display cage position data supplied from the input/output interface 102**.

With the control apparatus for an elevator thus constructed, when the position detector 112 operates in accordance with the ascent and descent of the cage, its output signal is supplied to the CPU 101 through the input/output interface 102. Then, the CPU 101 calculates the current position of the cage in accordance with the program stored in the EPROM 103 as in the prior art. The current position data of the cage obtained through the calculation is written into the E²PROM 104, thereby to be held. In addition, the current position data of the cage obtained through the calculation is sent through the input/output interface 102 and is displayed on the cage position display units **113*a* and 113*b*** disposed in the hall and the cage.

Here, when power failure has occurred due to any cause, all the circuit portions become inoperative simultaneously with the cutoff of power supply. Since, however, the E²PROM 104 holding the current position data of the cage is a nonvolatile memory, the stored data is reliably held in spite of the power failure. Accordingly, the elevator can return to the normal running as soon as the power supply is recovered.

Figure 4:
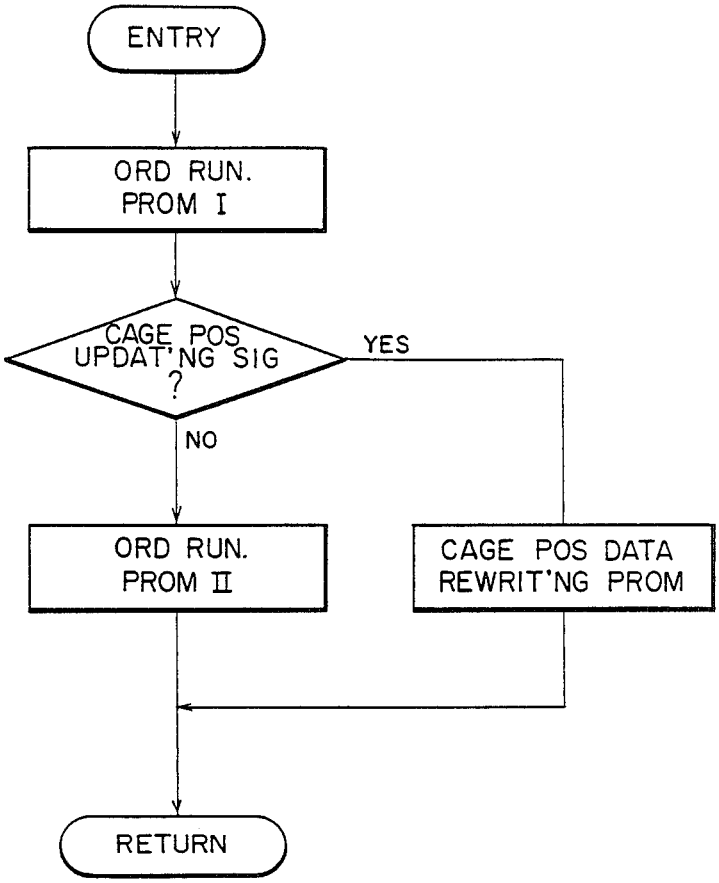
FIG. 4 is a flow chart showing the operation of the embodiment shown in FIG. 3.

Next, the writing of data into the E²PROM 104 requires a much longer time than the writing of data into the RAM 105. Accordingly, when a program for the processing of writing data into the E²PROM is executed every calculation cycle of the CPU 101, a calculation period becomes very long and the running control of the elevator cannot be performed appropriately. To cope with this, it is necessary that as shown in FIG. 4, a program for ordinary running is divided in two and is reliably executed every calculation cycle of the CPU 101. A running program I requiring a quick response, for example, a speed command value calculating program is first executed. Subsequently, the presence or absence of a cage position updating signal is checked. In the absence of the updating signal, a controlling program II not requiring a very quick response, for example, a program for selecting a running mode corresponding to a traffic volume, which does not particularly hamper the running control of the elevator even when a calculation in a part of the calculation cycle of the CPU 101 is omitted, is executed. Regarding the calculations of these programs, calculated results are stored in the RAM 105. In contrast, if the cage position updating signal is present, the running control program II is omitted, and the cage position data writing program is executed. In this way, the period of time for writing into the $E^2$PROM 104 for updating the cage position data is secured without hindering the running control of the elevator.

As described above, according to this invention, the current position data of a cage is stored and held in a nonvolatile semiconductor memory ($E^2$PROM) which can have its content rewritten in connection with a CPU. The invention therefore has the effect that the current position data of the cage can be reliably held without employing an expensive backup power source or the like.

What is claimed is:

1. A control apparatus for an elevator having a movable cage comprising:

a position detector responsive to cage movement;

a non-volatile semiconductor memory means for storing representations of cage position; and a microcomputer means operated under program control for controlling said position detector to produce signals representing instantaneous cage positions, and for continuously erasing and rewriting contents of said memory based on the signals to provide a continuously updated representation of instantaneous cage position in said non-volatile memory in the event of power failure.

2. A control apparatus for an elevator as defined in claim 1 wherein said microcomputer bypasses an ordinary running control program for controlling running operation of the elevator to execute a program for erasing and writing the instantaneous positions of the cage into said memory.

3. A control apparatus for an elevator as defined in claim 1 wherein the microcomputer means under program control executes a first program for calculating an output requiring a quick response executes a second program for calculating an output not requiring such a quick response so as to move the cage, and executes a cage position data writing program for updating the position of the cage, and in updating the cage position, executes the cage position data writing program without executing the second program.

4. A control apparatus for an elevator as defined in claim 3 further comprising a random access memory which stores the calculated results produced by said microcomputer in executing the first program and the second program, said memory means holding only the position data of the cage.

5. A control apparatus for an elevator as defined in claim 3 wherein the first program is a program for calculating a speed command value of the elevator, and the second program is a program for selecting a running mode corresponding to a traffic volume.

6. An elevator control apparatus comprising pulse generator means for producing output pulses corresponding to movement of a cage of an elevator, microcomputer means for processing the count value of the output pulses to obtain a cage position and absolute positional data of service floors, and a semiconductor memory which is nonvolatile and which can have its content rewritten, said semiconductor memory being connected to the microcomputer means and including memory means for storing absolute positional data of the service floors.

7. A control apparatus for an elevator as defined in claim 6 wherein when measuring positions of the respective service floors and writing the positional data into said memory, the microcomputer executes only processing programs required for the processing.

* * * * *